United States Patent [19]

Inamorato et al.

[11] 4,092,273

[45] May 30, 1978

[54] LIQUID DETERGENT OF CONTROLLED VISCOSITY

[75] Inventors: Jack T. Inamorato, Westfield; William Chirash, New Providence, both of N.J.

[73] Assignee: Colgate-Palmolive Company, New York, N.Y.

[21] Appl. No.: 762,218

[22] Filed: Jan. 24, 1977

Related U.S. Application Data

[63] Continuation of Ser. No. 511,760, Oct. 3, 1974, abandoned.

[51] Int. Cl.[2] ..... C11D 1/66

[52] U.S. Cl. ..... 252/548; 252/551; 252/559; 252/DIG. 14

[58] Field of Search ..... 252/548, 551, 559, DIG. 14

[56] References Cited

U.S. PATENT DOCUMENTS

| | | | |
|---|---|---|---|
| 3,812,041 | 5/1974 | Inamorato | 252/DIG. 14 |
| 3,869,399 | 3/1975 | Collins | 252/545 L |
| 3,893,955 | 7/1975 | Hewitt et al. | 252/551 |

*Primary Examiner*—Mayer Weinblatt

*Attorney, Agent, or Firm*—Richard N. Miller; Murray M. Grill; Herbert S. Sylvester

[57] ABSTRACT

A liquid detergent having a viscosity in the range of 40 to 100 centipoises at 24° C and which is fluid at 7° C which consists essentially of, by weight, from 10% to 60% of a water soluble $C_2$–$C_3$ alkoxylated $C_{10}$–$C_{18}$ alkanol nonionic detergent, 4 to 12% of $C_2$–$C_3$ alkanol, 1 to 6% of a water soluble salt of a dibasic acid of the formula $(CH_2)_n(COOH)_2$, wherein n is 3 to 5 as a viscosity control and gel prevention agent, and the balance water.

9 Claims, No Drawings

LIQUID DETERGENT OF CONTROLLED VISCOSITY

This is a continuation of application Ser. No. 511,760, filed Oct. 3, 1974, now abandoned.

This invention relates to a liquid detergent which is of a desired viscosity at room temperature and is fluid at lower temperatures. More particularly, it relates to a pourable, clear liquid laundry detergent including a nonionic synthetic organic detergent, a lower alkanol, water and a viscosity control agent, which serves to thin the detergent to the desired room temperature viscosity range and helps to prevent gelling at lower temperatures, thereby allowing the use of less alcohol in the formulation.

Liquid detergents are often considered to be more convenient to employ than dry powdered or particulate products and therefore have found substantial favor with consumers. They are readily measurable, speedily dissolved in the wash water, capable of being easily applied in concentrated solutions or dispersions to soiled areas on garments to be laundered and are non-dusting, and they usually occupy less storage space. Additionally, the liquid detergents may have incorporated in their formulations materials which could not stand drying operations without deterioration, which materials are often desirably employed in the manufacture of particulate detergent products. Although they are possessed of many advantages over unitary or particulate solid products, liquid detergents often have certain inherent disadvantages too, which have to be overcome to produce acceptable commercial detergent products. Thus, some such products separate out on storage and others separate out on cooling and are not readily redispersed. In some cases the product viscosity changes and it becomes either too thick to pour or so thin as to appear watery. Some clear products become cloudy and others gel on standing. To overcome these difficulties, it is often desirable to utilize a formulation which is essentially organic. Such a product contains little or no inorganic builder salt. Thereby, the most serious separation problems normally encountered in the manufacture of liquid laundry detergents are often avoided. However, even all-organic formulations have viscosity problems and in some cases as temperatures are lowered gelation occurs. In the past such problems have been overcome by the addition of a lower alkanol, e.g., ethanol, to the detergent. Recently there has been a shortage of ethanol and it and other chemicals are on allocation, making it important to conserve them and limit their uses in liquid detergents and other products. Accordingly, efforts have been made to discover materials that may be added and formulations that may be produced to desirably control the viscosities of liquid detergents.

In formulations of commercial liquid detergents based principally on nonionic synthetic organic detergent active ingredient in an aqueous medium, preferably with a lesser quantity of synthetic anionic organic detergent present, such as a polyethoxylated higher fatty alcohol sulfate or a higher alkyl benzene sulfonate, it has been discovered that the proportion of lower alkanol employed as a viscosity controlling or thinning agent can be significantly reduced when there is included in the formulation a small and acceptable quantity of a water soluble formate, a water soluble salt of a dibasic acid of a certain type or a mixture thereof.

In accordance with the present invention a liquid detergent having a viscosity in the range of 40 to 120 centipoises at 24° C. and which is fluid at 7° C. comprises from 10 to 40% of nonionic synthetic organic detergent, 4 to 12% of lower alkanol, 1.5 to 6% of a viscosity control agent selected from the group consisting of water soluble formates and water soluble salts of dibasic acids of the formula $(CH_2)_n(COOH)_2$, wherein $n$ is 1 to 6, and mixtures thereof, and 22 to 84.5% of water. Preferably the nonionic detergent is a polyethoxylated higher alkanol, the lower alkanol is ethanol or a mixture of ethanol and isopropanol, the viscosity control agent is an alkali metal formate or alkali metal adipate and the formulation contains a water soluble synthetic organic anionic detergent, such as a polyethoxy higher alkanol sulfate or a higher alkyl benzene sulfonate.

The nonionic synthetic organic detergents employed in the practice of the invention may be any of a wide variety of such compounds, which are well known and are described at length in the text *Surface Active Agents,* Vol. II, by Schwartz, Perry and Berch, published in 1958 by Interscience Publishers, and in McCutcheon's *Detergents and Emulsifiers,* 1969 Annual, the relevant disclosures of which are hereby incorporated by reference. Useful anionic, amphoteric and cationic detergents and surface active agents are also described therein. Usually, the nonionic detergents are poly-lower alkoxylated lipophiles wherein the desired hydrophile-lipophile balance is obtained from addition of a hydrophilic poly-lower alkoxy group to a lipophilic moiety. For the present compositions the nonionic detergent employed is preferably a poly-lower alkoxylated higher alkanol wherein the alkanol is of 10 to 18 carbon atoms and wherein the number of mols of lower alkylene oxide (of 2 or 3 carbon atoms) is from 3 to 12. Of such materials it is preferred to employ those wherein the higher alkanol is a higher fatty alcohol of 11 or 12 to 15 carbon atoms and which contain from 5 to 8 or 5 to 9 lower alkoxy groups per mol. Preferably, the lower alkoxy is ethoxy but in some instances it may be desirably mixed with propoxy, the latter, if present, usually being a minor (less than 50%) proportion. Exemplary of such compounds are those wherein the alkanol is of 12 to 15 carbon atoms and which contain about 7 ethylene oxide groups per mol, e.g., Neodol 25-7 and Neodol 23-6.5, which products are made by Shell Chemical Company, Inc. The former is a condensation product of a mixture of higher fatty alcohols averaging about 12 to 15 carbon atoms, with about 7 mols of ethylene oxide and the latter is a corresponding mixture wherein the carbon atom content of the higher fatty alcohol is 12 to 13 and the number of ethylene oxide groups present averages about 6.5. The higher alcohols are primary alkanols. Other examples of such detergents include Tergitol® 15-S-7 and Tergitol 15-S-9, both of which are linear secondary alcohol ethoxylates made by Union Carbide Corp. The former is a mixed ethoxylation product of 11 to 15 carbon atoms linear secondary alkanol with seven mols of ethylene oxide and the latter is a similar product but with nine mols of ethylene oxide being reacted.

Also useful in the present compositions as a component of the nonionic detergent are higher molecular weight nonionics, such as Neodol 45-11, which are similar ethylene oxide condensation products of higher fatty alcohols, with the higher fatty alcohol being of 14 to 15 carbon atoms and the number of ethylene oxide groups per mol being about 11. Such products are also made by Shell Chemical Company. Other useful nonionics are represented by Plurafac B-25 (BASF Chemical Company), the reaction product of a higher linear alcohol and a mixture of ethylene and propylene oxides, containing a mixed chain of ethylene oxide and propylene oxide, terminated by a hydroxyl group.

In the preferred poly-lower alkoxylated higher alkanols, to obtain the best balance of hydrophilic and lipophilic moieties the number of lower alkoxies will usually be from 40 to 100% of the number of carbon atoms in the higher alcohol, preferably 40 to 60% thereof and the nonionic detergent will preferably contain at least 50% of such preferred poly-lower alkoxy higher alkanol. Higher molecular weight alkanols and various other normally solid nonionic detergents and surface active agents may be contributory to gelation of the liquid detergent and consequently, will preferably be omitted or limited in quantity in the present compositions, although minor proportions thereof may be employed for their cleaning properties, etc. With respect to both preferred and less preferred nonionic detergents the alkyl groups present therein will most preferably be linear although a minor degree of slight branching may be tolerated, such as at a carbon next to or two carbons removed from the terminal carbon of the straight chain and away from the ethoxy chain, if such branched alkyl is no more than three carbons in length. Normally the proportion of carbon atoms in such a branched configuration will be minor, rarely exceeding 20% of the total carbon atom content of the alkyl. Similarly, although linear alkyls which are terminally joined to the ethylene oxide chains are highly preferred and are considered to result in the best combination of detergents, biodegradability and non-gelling characteristics, medial or secondary joinder to the ethylene oxide in the chain may occur. It is usually in only a minor proportion of such alkyls, generally less than 20% but, as is in the cases of the mentioned Terigtols, may be greater. Also, when propylene oxide is present in the lower alkylene oxide chain, it will usually be less than 20% thereof and preferably less than 10% thereof.

When greater proportions of non-terminally alkoxylated alkanols, propylene oxide-containing poly-lower alkoxylated alkanols and less hydrophile-lipophile balanced nonionic detergent than mentioned above are employed and when other nonionic detergents are used instead of the preferred nonionics recited herein, the product resulting may not have as good detergency, stability, viscosity and non-gelling properties as the preferred compositions but use of the viscosity controlling compounds of the invention can also improve the properties of the detergents based on such nonionics. In some cases, as when a higher molecular weight poly-lower alkoxylated higher alkanol is employed, often for its detergency, the proportion thereof will be regulated or limited, as in accordance with the results of various experiments, to obtain the desired detergency and still have the product non-gelling and of desired viscosity. Also, it has been found that it is only rarely necessary to utilize the higher molecular weight nonionics for their detergent properties since the preferred nonionics described herein are excellent detergents and additionally, permit the attainment of the desired viscosity in the liquid detergent without gelation at low temperatures.

With the nonionic detergent, which is the major synthetic organic detergent of the present phosphorus-free (and essentially nitrogen-containing builder-free) liquid detergent compositions, there is employed an anionic detergent, preferably a sulfated ethoxylated higher fatty alcohol of the formula $RO(C_2H_4O)_mSO_3M$, wherein R is a fatty alkyl of from 10 to 18 or 20 carbon atoms, $m$ is from 2 to 6 or 8 (preferably being from 1/5 to $\frac{1}{3}$ or $\frac{1}{2}$ the number of carbon atoms in R) and M is a solubilizing salt-forming cation, such as an alkali metal, ammonium, lower alkylamino or lower alkanolamino, or a higher alkyl benzene sulfonate wherein the higher alkyl is of 10 to 15 carbon atoms and the salt-forming ion on the sulfonic acid group is M, described above.

As is the case with the preferred nonionic detergents, the present poly-lower alkoxy higher alkanol sulfates are readily biodegradable and of better detergency when the fatty alkyl is terminally joined to the poly-lower oxyalkylene chain, which is terminally joined to the sulfate. Again, as in the case of the nonionic detergents, a small proportion, for example, not more than 10%, of branching, and medial joinder are tolerable. Generally, it will be preferred for the alkyl in the anionic alkoxylate detergent, as in the nonionic detergent, to be a mixture of different chain lengths, as 11, 12, 13, 14 and 15 carbon atom or 12 and 13 carbon atom chains, rather than all of one chain length. Nevertheless, the invention is applicable to liquid detergents containing pure nonionic and anionic components.

Of course, ethylene oxide is the preferred lower alkylene oxide of the anionic alkoxylate detergent, as it is with the nonionic detergent, and the proportion thereof in the polyethoxylated higher alkanol sulfate is preferably 2 to 5 mols of ethylene oxide groups present per mol of anionic detergent and in more preferred compositions from 2 to 4 mols will be present, with three mols being most preferred, especially when the higher alkanol is of 12 to 13 carbon atoms or 11 or 12 to 15 carbon atoms. To maintain the desired hydrophile-lipophile balance, when the carbon atom content of the alkyl chain is in the lower portion of the 10 to 18 carbon atom range the ethylene oxide content of the detergent may be reduced to about two mols per mol whereas when the higher alkanol is of 16 to 18 carbon atoms, in the higher part of the range, the number of ethylene oxide groups may be increased to 4 or 5 and in some cases to as high as 8 or 9. Similarly, the salt-forming cation may be altered to obtain the best solubility. It may be any suitable solubilizing metal or radical but will most frequently be alkali metal, e.g., sodium, or ammonium. If lower alkylamine or alkanolamine groups are utilized the alkyls and alkanols will usually contain from 1 to 4 carbon atoms and the amines and alkanolamines may be mono-, di- and tri-substituted, as in monoethanolamine, diisopropanolamine and trimethylamine.

The poly-lower alkoxy higher alkanol sulfates, are highly preferred supplementing detergents in the present compositions but other anionic detergents may be employed with them or in place of such compounds. Particularly, the higher alkyl benzene sulfonates are also preferred and alph-olefin sulfonates, paraffin sulfonates and higher alcohol sulfates may be used. A preferred polyethoxylated alcohol sulfate detergent is available from Shell Chemical Company and is marketed as Neodol 25-3S. This material, the sodium salt, is normally sold as a 60% active ingredient product and includes about 40% of aqueous solvent medium, of which a minor proportion is ethanol. In the formulations given Neodol 25-3S will be considered as 100% active material and the water and alcohol contents thereof will be separately listed as liquid detergent components. Although Neodol 25-3S is the sodium salt, the potassium salt and other suitable soluble salts of the triethenoxy higher alcohol (12 to 15 carbon atoms) sulfate and other such compounds herein described, such as have already been referred to, may also be used in partial or complete substitution for the sodium salts. As with the various materials of the present compositions, mixtures thereof may be utilized.

Examples of the higher alcohol polyethenoxy sulfates which may be employed as the anionic detergent constituent of the present liquid detergents or as partial substitutes for this include: mixed $C_{12-15}$ normal or primary alkyl triethenoxy sulfate, sodium salt; myristyl triethenoxy sulfate, potassium salt; n-decyl diethenoxy sulfate, diethanolamine salt; lauryl diethenoxy sulfate, ammonium salt; palmityl tetraethenoxy sulfate, sodium salt; mixed $C_{14-15}$ normal primary alkyl mixed tri- and tetraethenoxy sulfate, sodium salt; stearyl pentaethenoxy sulfate, trimethylamine salt; and mixed $C_{10-18}$ normal primary alkyl triethenoxy sulfate, potassium salt. Minor proportions of the corresponding branched chain and medially alkoxylated detergents, such as those described above but modified to have the ethoxylation at a medial carbon atom, e.g., one located four carbons from the end of the chain, may be employed and the carbon atom content of the higher alkyl will be the same. Similarly, the joinder to the normal alkyl may be at a secondary carbon one or two carbon atoms removed from the end of the chain. In either case, as previously indicated, only minor proportions should be present, such as 10 or 20%, in the usual case.

Although the polyethoxylated higher alkanol sulfates are preferred anionic detergents, good liquid detergents are also made by substituting for them, either wholly or in part, another type of preferred anionic detergent, higher (10 to 18 or 20 carbon atoms) alkyl benzene sulfonate salts wherein the alkyl group preferably contains 10 to 15 carbon atoms, most preferably being a straight chain alkyl radical of 12 or 13 carbon atoms. Preferably, such an alkyl benzene sulfonate has a high content of 3- (or higher) phenyl isomers and a correspondingly low content (usually well below 50%) of 2- (or lower) phenyl isomers; in other words, the benzene ring is preferably attached in large part at the 3, 4, 5, 6 or 7 position of the alkyl group and the content of isomers in which the benzene ring is attached at the 1 or 2 position is correspondingly low. Typical such alkyl benzene sulfonate surface active agents are described in U.S. Pat. No. 3,320,174. Of course, more highly branched alkyl benzene sulfonates may also be employed but usually are not preferred, due to their biostability (lack of biodegradability).

Other anionic detergents which are useful are the olefin sulfonate salts. Generally, these contain long chain alkenyl sulfonates or long chain hydroxyalkane sulfonates (with the OH being on the carbon atom which is not directly attached to the carbon atom bearing the $—SO_3H$ group). The olefin sulfonate detergent usually comprises a mixture of such types of compounds in varying amounts, often together with long chain disulfonates or sulfate-sulfonates. Such olefin sulfonates are described in many patents, such as U.S. Pat. Nos. 2,061,618; 3,409,637; 3,332,880; 3,420,875; 3,428,654; 3,506,580; and British Pat. No. 1,129,158. The number of carbon atoms in the olefin sulfonate is usually within the range of 10 to 25, more commonly 10 to 18 or 20, e.g., a mixture principally of $C_{12}$, $C_{14}$ and $C_{16}$, having an average of about 14 carbon atoms, or a mixture principally of $C_{14}$, $C_{16}$ and $C_{18}$, having an average of about 16 carbon atoms.

Another class of useful anionic detergents is that of the higher paraffin sulfonates. These may be primary paraffin sulfonates made by reacting long chain alpha-olefins and bisulfites, e.g., sodium bisulfite, or paraffin sulfonates having the sulfonate groups distributed along the paraffin chain, such as the products made by reacting a long chain paraffin with sulfur dioxide and oxygen under ultraviolet light, followed by neutralization with sodium hydroxide or other suitable base (as in U.S. Pat. Nos. 2,503,280; 2,507,088; 3,260,741; 3,372,188; and German Pat. No. 735,096). The paraffin sulfonates preferably contain from 13 to 17 carbon atoms and will normally be the monosulfonate but if desired, may be di-, tri- or higher sulfonates. Typically, the di- and polysulfonates will be employed in admixture with a corresponding monosulfonate, for example, as a mixture of mono- and disulfonates containing up to about 30% of the disulfonate. The hydrocarbon substituent thereof will preferably be linear but if desired, branched chain paraffin sulfonates can be employed, although they are not as good with respect to biodegradability. The paraffin sulfonate may be terminally sulfonated or the sulfonate substituent may be joined to the 2-carbon or other carbon atom of the chain and similarly, any di- or higher sulfonate employed may have the sulfonate groups distributed over different carbons of the hydrocarbon chain.

Other useful anionic detergents include the higher acyl sarcosinates, e.g., sodium N-lauroyl sarcosinate; higher fatty alcohol sulfates, such as sodium lauryl sulfate, sodium tallow alcohol sulfate; sulfated oils; sulfates of mono- or diglycerides of higher fatty acids, e.g., stearic monoglyceride monosulfate; although, of these, the sodium higher alcohol sulfates have been found to be inferior to the polyethoxylated sulfates in detergency; aromatic poly(lower alkenoxy) ether sulfates, such as the sulfates of the condensation products of ethylene oxide and nonyl phenol (usually having 1 to 20 oxyethylene groups per molecule, preferably 2 to 12); polyethoxy higher alcohol sulfates and alkyl phenol polyethoxy sulfates having a lower alkoxy (of 1 to 4 carbon atoms, e.g., methoxy) substituent on a carbon close to that carrying the sulfate group, such as monomethyl ether monosulfate of a long chain vicinal glycol, e.g., mixture of vicinal alkane diols of 16 or 17 to 18 or 20 carbon atoms in a straight chain; acyl esters of isethionic acid, e.g., oleyl isethionates; acyl N-methyl taurides, e.g., potassium N-methyl lauroyl or oleyl taurides; higher alkyl phenyl polyethoxy and higher alkyl polyethoxy sulfonates; higher alkyl phenyl disulfonates, e.g., pentadecyl phenyl disulfonate; and higher fatty acid soaps, e.g., mixed coconut oil and tallow soaps in a 1:4 ratio.

The aforementioned types of anionic detergents, the carboxylates, sulfates and sulfonates, are generally preferred but the corresponding organic phosphates and phosphonates may also be employed when their contents of phosphorus are not objectionable. Generally, the water soluble anionic synthetic organic detergents, (including soaps), as was previously indicated, are salts of alkali metal cations, such as potassium, lithium, and especially sodium, although salts of ammonium and substituted ammonium cations, such as those previously described, e.g., triethanolamine, triisopropylamine, may be used too. In the above exemplifications of anionic detergents it should be considered that the sodium, potassium, ammonium and triethanolamine salts are individually recited for each detergent.

Although it is contemplated that in some circumstances amphoteric detergents, such as the higher fatty carboxylates, phosphates, sulfates or sulfonates which contain a cationic substituent such as an amino group, which may be quaternized, e.g., with a lower alkyl group, or chain extended at the amino group by condensation with a lower alkylene oxide, e.g., ethylene oxide, may be employed in the present compositions in minor proportions in replacement of the anionic detergent or a part thereof or in replacement of part of the nonionic detergent, generally the compositions containing such amphoterics or cationic detergents will not be as effective and may have a greater tendency to gel or thicken on standing. Therefore they are often avoided. If such properties are unobjectionable, minor proportions of such amphoterics as Miranol C2M, sold by Miranol Chemical Company, or Deriphat 151, a sodium N-coco betaamine propionate, sold by General Mills, Inc., may be utilized. A cationic detergent that may sometimes be useful is distearyl dimethyl ammonium chloride (it has fabric softening activity) and the higher fatty amine oxides, such as Aromox 18/12, which is bis(2-hydroxyethyl) octadecyl amine oxide, sold by Armour Industrial Chemical Co., sometimes classified as a cationic, may be employed.

Nonionic detergents that may be utilized within the broadest aspect of the invention, in substitution for a proportion of the described preferred polyethoxylated higher alkanols or sometimes, in replacement thereof, include the poly (lower alkenoxy) derivatives usually prepared by the condensation of a lower alkylene oxide, e.g., ethylene oxide, propylene oxide, with compounds having a hydrophobic chain, usually a hydrocarbon chain and containing one or more active hydrogen atoms, such as higher alkyl phenols, middle alkyl phenols, higher fatty acids, higher fatty mercaptans, higher fatty amides and polyols, normally of a carbon atom content of 10 to 18 and alkoxylated with an average of about 3 to 20, typically 3 to 12 alkylene oxide units. Examples of such materials are the polyethylene oxide condensates of $C_{12-15}$ higher fatty acids, higher fatty mercaptans, higher fatty amides, higher alkyl phenols and middle alkyl phenols wherein the alkyls are of 7 to 9 carbon atoms, all of which are ethoxylated with 5, 7 and 9 ethoxies per mol.

The lower alkanol is of 1 to 4 carbon atoms, preferably 2 to 3 carbon atoms and most preferably is ethanol or a mixture of ethanol and isopropanol. Primary, secondary and tertiary butanol may be employed but usually will not be more than 20% of the alkanol present and preferably will be omitted. n-Propanol may be utilized but the amount thereof will normally be restricted to the no more than 20% of the alkanol content and preferably the total contents of the butanols and n-propanol will be limited to 10%. Isopropanol or mixtures thereof with ethanol may be employed up to the full alkanol content of the liquid detergent. Often, rather than to use all isopropanol, a mixture with ethanol is made because the isopropanol has a distinctive odor which is more pronounced than that of ethanol. Also, it may not be as good a solubilizer. Accordingly, it is highly preferred to use ethanol or a mixture thereof with isopropanol as the sole alkanol and organic solvent in these liquid detergents. In mixtures of ethanol and isopropanol the isopropanol may be a major component but preferably the ethanol is, usually being from 60 to 90%, preferably about 75% (3:1 ratio). Of course, other mixtures of the various alkanols may be used and in such mixtures it is also preferred that a major proportion of the alkanol content should be ethanol. In a similar manner, mixtures of the various individual detergents and mixtures of types thereof may be employed, as may be mixtures of the various other constituents of these compositions, e.g., viscosity control agents, optical brighteners, anti-redeposition agents, chelating agents and, in some cases, organic builders, e.g., sodium citrate and potassium gluconate, and it is intended that when referring to such components herein, mixtures should be included.

The viscosity control agent utilized to maintain the desired viscosity of the liquid detergent, prevent gelation at low temperatures and allow a reduction in lower alkanol solvent content is preferably a water soluble formate. Sodium formate is preferred but alkali metal formates may be utilized, e.g., potassium formate and various other water soluble formates, including formic acid, which may be added to the liquid detergent composition, wherein it dissolves, ionizes and/or reacts to produce essentially the same type of liquid detergent as results from the addition of the alkali metal formate in salt form. Thus, liquid detergents made by such method are considered to be the full equivalents of those made by the addition of sodium or other alkali metal formate and are included within the scopes of such descriptions. Other formates that may be employed are those of water soluble cations, such as previously described as salt-forming cations for the anionic detergents. Although it is preferred to employ the formate viscosity control agent it has been found that various salts of dibasic acids can also be successfully used, among which the best appears to be disodium adipate, referred to herein as sodium adipate. Other salts of dibasic acids of the formula $(CH_2)_n(COOH)_2$ where $n$ is 1 to 6, may also be employed and in some instances the salts of monounsaturated acids of the same chain lengths and configurations may be used. However, it is highly preferred to utilize the saturated aliphatic straight chain terminally carboxylated compounds. It is more preferable to employ those wherein $n$ is 3 to 5, most preferably 4 and wherein the acid is fully neutralized, but the acid salts may be used, too.

Among the dibasic acids that may be employed, either as the mono- or disalts, are malonic, succinic, glutaric, adipic and pimelic acids. An unsaturated dibasic acid, maleic acid, can also be used, at least in part. The acids may be employed without prior neutralization or may be used as their salts, such as disodium malonate, monopotassium succinate, di-triethanolamine glutarate, disodium adipate and monosodium pimelate.

Water for formulating the present liquid detergents may come from the starting materials themselves, such as solutions or suspensions of the anionic detergent salts, or may be added. When added it will be preferable to utilize deionized water or water of low hardness, e.g., under 50 p.p.m. of hardness salts, as calcium carbonate, preferably under 10 p.p.m. $CaCO_3$. However, while it is undesirable to utilize hard waters, this may be done and satisfactory products may be made from waters of hardnesses as high as 200 p.p.m. but generally the use of such water is avoided where possible.

To assist in solubilizing the detergents and optical brighteners which may be present in the liquid detergents a small proportion of alkaline material or a mixture of such materials is often included in the present formulations. Suitable alkaline materials include mono-, di- and trialkanolamines, alkyl amines, ammonium hydroxide and alkali metal hydroxides. Of these, the preferred materials and the alkanolamines, preferably the trialkanolamines and of these, especially triethanolamine. The pH of the final liquid detergent, containing such a basic material will usually be neutral or slightly basic. Satisfactory pH ranges are from 7 to 10 preferably about 7.5 to 9.5 but because a pH reading of the liquid detergent, using a glass electrode and a reference calomel electrode, may be inaccurate, due to the detergent system often being essentially non-aqueous, a better indication is obtained by measuring the pH of a 1% solution of the liquid detergent in water. Such a pH will also normally be in the range of about 7 to 10, preferably 7.5 to 9.5. In the wash water the pH will usually be in this range or might be slightly more acidic, as by 0.5 to 1 pH unit, due to the organic acid content of soiled laundry.

The optical fluorescent brighteners or whiteners employed in the liquid detergent are important constituents of modern detergents which give washed laundry and materials a bright appearance so that the laundry is not only clean but also looks clean. Due to the variety of synthetic fibers incorporated in the textiles which are made into clothing and other items of laundry and the importance of substantivity of the brightener compound to the fibers, many different optical brightening compounds have been made, which may be incorporated in the present detergent compositions, often in mixture. Although it is possible to utilize a single brightener for a specific intended purpose in the present liquid detergents it is generally desirable to employ mixtures of brighteners which will have good brightening effects on cotton, nylons, polyesters and blends of such materials and which are also bleach stable. A good description of such types of optical brighteners is given in the article *Optical Brighteners and Their Evaluation* by Per S. Stensby, a reprint of articles published in *Soap and Chemical Specialties* in April, May, July, August and September, 1967, especially at pages 3–5 thereof. That article and U.S. Pat. No. 3,812,041, issued May 21, 1974, both of which are hereby incorporated by reference for their relevant disclosures, contain detailed descriptions of a wide variety of suitable optical brighteners. Accordingly, only a very brief description of these materials will be given here.

The cotton brighteners, frequently referred to as CC/DAS brighteners because of their derivation from the reaction product of cyanuric chloride and the disodium salt of diaminostilbene disulfonic acid in a molar proportion of 1:2, are bistriazinyl derivatives of 4,4'-diaminostilbene-2,2'-disulfonic acid. Bleach stable brighteners are usually benzidine sulfone disulfonic acids, nathphatriazolylstilbene sulfonic acids or benzimidazolyl derivatives. The polyamide brighteners, especially good for nylons, are usually either aminocoumarins or diphenyl pyrazoline derivatives. Additionally, there are polyester brighteners, which also serve to whiten polyamides. The brighteners are used in their acid forms or as salts in the present liquid detergent compositions and in the wash waters resulting from use of the liquid detergents the brighteners are maintained sufficiently soluble so as to be effective and uniformly substantive to the materials of the laundry being washed, due to the presence in the detergents of the detergent components, especially the nonionic detergents, the alkanol and the basic material.

Among the brighteners that are used in the present systems are: Calcofluor 5BM (American Cyanamid); Calcofluor White ALF (American Cyanamid); SOF A-2001 (CIBA); CDW (Hilton-Davis); Phorwite RKH, Phorwite BBH and Phorwite BHC (Verona); CSL, powder, acid (American Cyanamid); FB 766 (Verona); Blancophor PD (GAF); UNPA (Geigy); Tinopal CBS and Tinopal RBS 200 (Geigy). The acid or "nonionic" forms of the brighteners tend to be solubilized by alcohols of the present formulas, while the salts tend to be water soluble. Thus, a combination of such solvents and the detergent combination serves to keep the fluorescent brighteners dissolved.

Adjuvants may be present in the liquid detergent to give it additional properties, either functional or aesthetic. Thus, soil suspending or anti-redeposition agents may be used, such as polyvinyl alcohol, sodium carboxymethyl cellulose, hydroxypropylmethyl cellulose; enzymes, e.g., protease, amylase; thickeners, e.g., gums, alginates, agar agar; hydrotropes; e.g., sodium xylene sulfonate, ammonium benzene sulfonate; foam improvers, e.g., lauric myristic diethanolamide; foam destroyers, e.g., silicones; bactericides, e.g., tribromosalicylanilide, hexachlorophene; fungicides; dyes; pigments (water dispersible); preservatives; ultraviolet absorbers; fabric softeners; pearlescing agents; opacifying agents, e.g., behenic acid, polystyrene suspensions; and perfumes. Of course, such materials will be selected for the properties desired in the finished product and to be compatible with the other constituents thereof. Among the adjuvants that may be employed are dihydric or trihydric lower alcohols which, in addition to having solubilizing powers and reducing the flash point of the product, also can act as antifreezing constituents and may improve compatibilities of the solvent system with particular product components. Among these compounds the most preferred group includes the lower polyols of 2 to 3 carbon atoms, e.g., ethylene glycol, propylene glycol and glycerol, but the lower alkyl ($C_1$–$C_4$) etheric derivatives of such compounds, known as Cellosolves®, may also be employed. The proportions of such substitutes for the lower alkanols will be limited, normally being held to no more than 20% of the total alcohol content of the liquid detergent.

The proportions of the various components of the present heavy duty liquid detergents are important for the manufacture of a uniform product of desirable viscosity and acceptable heavy duty laundering action which does not gel at low temperatures or upon standing in an open container at room temperature. So as to promote solubility of the fluorescent brighteners and other constituents and to make a clear, homogeneous and readily pourable liquid product, from 10 to 60% of the total liquid detergent concentrate should be nonionic detergent and it is preferred that this be nonionic fatty alcohol-ethylene oxide condensation product, with a major proportion, from 50 to 100% thereof being of a low molecular weight, wherein the fatty alcohol is of 10 to 15 carbon atoms and contains from 3 to 8 lower alkylene oxides groups per mol, and a minor proportion, 0 to 49.9% being of a corresponding higher condensate, wherein the fatty alcohol is of 16 to 18 carbon atoms and the number of lower alkylene oxide groups per mol is from 9 to 12. Preferably, especially when an anionic detergent is present in the liquid product, the proportion of the nonionic detergent is from 20 to 40% and more preferably it is 30 to 40%, with the best formula known at the present time including about 34%. The proportion of anionic detergent, such as polyethoxy higher alkanol sulfate will usually be in the range of 3 to 15%, preferably 4 to 12% and most preferably 7 to 10% with the best formula known at the present including about 8.5% thereof. The ratio of total nonionic detergent to anionic detergent will normally be from 15:1 to 1:1, with 8:1 to 2:1 being preferred and 5:1 to 3:1 being most preferred.

The lower alcohol in the liquid detergent will generally be present in a sufficient proportion to aid in dissolving and/or stabilizing the various constituents in the final product but in the most preferred embodiments of the invention the proportion of alcohol employed will be such that without the viscosity control agent present the liquid detergent would be of undesirable viscosity, normally too high, would gel in the bottle on storage or after a short exposure to air at room temperature, would not be fluid at low temperatures, such as 7° C. or would separate. The content of alcohol employed, together with the viscosity control agent, avoids such undesirable effects. The use of the viscosity control agent allows a reduction in the quantity of lower alcohol required in these formulations and in this respect the present invention is an improvement over that described in U.S. Pat. No. 3,812,041. The proportions of lower alkanol used will normally be from 4 to 12%, preferably 6 to 10%, more preferably 6 to 8% and at the present time most preferably about 7%. Although these alcohol levels are not so high as to prevent freezing at very low temperatures the product will thaw to a pourable homogeneous liquid and it is pourable at 7° C., the lowest temperature encountered in normal use.

The viscosity control agent utilized or a mixture of such agents will normally be from 1.0 to 6% of the final detergent product, preferably 1.5 to 5%, more preferably 2 to 4% and most preferably about 3%. When such quantities of the viscosity control agent are employed it has been found that the percentage of alcohol needed in the product to maintain its desirable characteristics, as previously described, may be reduced by 1 to 6% and such reduction is most usually in the range of 2 to 3%. Such a saving in ethanol, which is difficult to obtain at this time, allows the marketing of almost 50% more of this detergent product than would be the case were the viscosity control agent not used and reliance for viscosity control, etc., placed entirely on the incorporation of the lower alcohol in the liquid detergent. Thus, the present detergents represent a significant discovery because the savings in alcohol for one manufacturer alone can amount to hundreds of thousands of gallons or over a million liters per year, can therefore allow the maintenance of nationwide marketing of a liquid detergent product and can avoid the difficulties encountered when such a product is in short supply.

The percentage of water, the main solvent in the present compositions (exempting the nonionic detergent) will usually be from 22 to 84.5%, preferably 29 to 69.5% and more preferably 34 to 57.5%. In the present most preferred formulations there will be about 44 to 46% of water.

The content of a basic additive or alkalizing agent, such as triethanolamine, will usually be from 0.1 to 5% of the detergent, preferably 0.5 to 3% thereof. The total proportion of optical brightener, usually a mixture of brighteners, will normally be from 0.05 to 1.5%, preferably 0.1 to 1% and most preferably 0.5 to 1%.

In view of the different types of adjuvants which may be present in the liquid detergents, useful for widely different purposes, the proportions thereof employed may vary greatly. Generally, however, the total proportion of adjuvants, including the pH adjusting adjuvants and optical brighteners previously mentioned, will not exceed 10%, preferably will be less than 5% and more preferably less than 3%, with individual components not exceeding 5%, preferably 3% and more preferably being not more than 2% of the product. The use of greater proportions of the adjuvants can significantly change the properties of the liquid detergent and therefore, is to be avoided.

The liquid detergents of the present invention, can be made by simple manufacturing techniques which do not require any complicated equipment or expensive operations. In a typical manufacturing method the optical brighteners may be slurried in the monohydric alcohol, after which water is added to the slurry, together with a small amount of a base, such as triethanolamine, which helps to partially dissolve the previously suspended material but does not usually yield a clear solution. Addition of the detergent combination usually results in the remainder of the brightener dissolving to make a clear solution. Then the viscosity control agent is added as the acid, acidic salt or completely neutralized salt, preferably the sodium or potassium salt, and agitation is continued until the solution becomes clarified, which may normally take about 5 to 10 minutes. At this point other adjuvants may be added, followed by perfume and dye to give the product its final desired properties, including appearance and aroma. If desired the viscosity control additive may be incorporated earlier in the procedure. All of the above operations may be effected at room temperature, although suitable temperatures within the range of 20° to 50° C. may be employed, as desired, with the proviso that when volatile materials, such as perfume, are added, the temperature should be low enough so as to avoid objectionable losses. Additions of the various adjuvants may be effected at suitable points in the process but for the most part these will be added to the final product or near the end of the process. The product obtained will usually have a pH within the range of 7 to 10, e.g., 7.5, and a density within the range of from 0.9 to 1.1, preferably from 0.95 to 1.05. The viscosity of the product at 25° C. will be in the range of 40 to 120 centipoises, preferably from 40 to 100 centipoises, more preferably 70 to 100 centipoises and most preferably 80 to 95 centipoises, according to measurements that are made with a Brookfield viscosimeter at room temperature, using a No. 1 spindle at 12 revolutions per minute.

Use of the present compositions is very easy and efficient. Compared to heavy duty laundry detergent powders, much smaller volumes of the present liquids may be employed to obtain cleaning of soiled laundry. For example, using a typical formulation of this invention, containing about 34% of the fatty alcohol-ethylene oxide condensate nonionic detergent and 8.5% of the alkoxylated alcohol sulfate anionic detergent, only about 60 grams or ¼ cup of liquid needs to be used for a full tub of wash in a top-loading automatic washing machine in which the water volume is 15 to 18 gallons (55 to 75 liters) and even less (about ½) is needed for front-loading machines. Thus, the concentration of liquid detergent in the wash water is only on the order of 0.1%. Usually, the proportion of liquid detergent will be from 0.05 to 0.3%, preferably 0.08 to 0.2% and more preferably about 0.1 to 0.15%. The proportions of the various constituents of the liquid detergent, based on examples to be given, may vary accordingly. Equivalent results can be obtained by using greater proportions of a more dilute liquid detergent but the greater quantity needed will require additional packaging and shipping space and will be less convenient for the consumer to use. Also, more highly diluted products will be more apt to freeze in cold weather, may not redisperse and may be more subject to hydrolysis and chemical changes on storage.

Although it is preferred to employ wash water of reasonably low hardness at an elevated temperature, the present liquid detergents are also useful in laundering clothes and other items in hard waters and in extremely soft waters at room temperature and lower. Thus, water hardnesses may range from 0 to over 300 parts per million as calcium carbonate and washing temperatures may be from 10° C. to 80° C. Preferably the temperature will be room temperature (20° to 25° C.) to 70° C. In American laundering practice it is typically found that the wash water, if considered to be hot, is at a temperature of about 50° C. and if considered to be cold, is at a temperature of 10° to 20° C. Preferably, the water used will have a hardness of 50 to 150 p.p.m. and will contain both magnesium and calcium hardness ions, usually with the calcium hardness being a major proportion thereof. Although washing will most often be effected in an automatic washing machine, of either the top or side loading type, followed by rinse or spin and draining and/or wringing operations, the detergent may also be used for hand washing laundry. In such cases the concentration in the wash water of the liquid detergent will often be increased and sometimes it may be employed full strength to assist in washing out otherwise difficult to remove soils or stains. After completion of the normal washing and spinning operations it will be a general practice to dry the laundry in an automatic dryer soon afterward but other modes of drying may also be utilized.

The compositions of this invention will now be more fully illustrated by the following specific examples thereof, which are intended to be illustrative and in no way limitative. Unless otherwise indicated, all parts and percentages are by weight and temperatures are in ° C.

EXAMPLE 1

| | % |
|---|---|
| $RO(C_2H_4O)_7H$ (Neodol 25-7, R = mixed 12, 13, 14 and 15 carbon atoms primary alkyl) | 34.0 |
| $RO(C_2H_4O)_3SO_3Na$ (Neodol 25-3S, R = mixed 12, 13, 14 and 15 carbon atoms primary alkyl) | 8.5 |
| SD-40 denatured alcohol | 10.0 |
| Sodium formate | 4.0 |
| Triethanolamine | 1.3 |
| Optical brightener mixture (56% Tinopal CBS, 25% Phorwite BBH and 19% Phorwite BHC) | 0.8 |
| Color solution (1% Alizarin Sky Blue, 0.5% Sirius Supra Blue BRL and 98.5% water) | 1.0 |
| Perfume | 0.4 |
| Deionized water | 40.0 |
| | 100.0 |

A clear liquid detergent of the above formula is prepared at room temperature by slurrying the mixture of optical brighteners in the SD-40 alcohol, followed by the addition of water and triethanolamine with stirring, after which the Neodol 25-7 and Neodol 25-3S are added. After a few minutes of agitation at moderate speed (7 minutes at 100 revolutions per minute stirrer speed) the room temperature solution becomes clear. Then there are added to it the sodium formate, color solution and perfume, after preliminary dissolving of the sodium formate in a portion of the water (usually about ¼ of the water added).

The viscosity of the liquid detergent is measured at room temperature (24° C.) and is found to be 68 centipoises. The viscosity is measured with a No. 1 spindle of a Brookfield viscosimeter, Model LV, with the spindle rotating at 12 r.p.m. The density of the detergent is about 1.01 g./ml. at 25° C. and its pH is about 9.0. The physical appearance of the liquid detergent is noted after standing for one hour in an open beaker with its surface open to the atmosphere. No skin or gel is noted on the surface. When such a test is continually repeated, with the test liquid being returned to a bottle between testings, still no gelation or skin formation takes place. The temperature of the liquid detergent is lowered to 7° C. and maintained there for at least two weeks, after which, when tested for pourability it is found that the product is fluid and satisfactorily pourable.

A top loading automatic washing machine is loaded with 3.6 kilograms of mixed soiled laundry and is filled with seventy liters of water at 50° C. Sixty grams of the liquid detergent are added to the washing machine tub and a normal wash cycle is initiated. After completion of the washing and accompanying rinsing, which takes 45 minutes, the washed clothing is examined and is compared with a control mixed wash washed by a commercial type detergent containing 30% of pentasodium tripolyphosphate and 12.5% of sodium dodecyl benzene sulfonate. The washings of the laundry are found to be essentially equivalent or in favor of the experimental formula. This is also the case after several launderings of the same materials, which are repeatedly soiled between washings, and when washings are effected at lower temperatures, e.g., 10°, 20° and 30° C.

In a variation of the experiment the sodium formate solution is added with the water and triethanolamine and a good product is also obtained. Similarly, formic acid or other alkali metal, ammonium or triethanolamine salt is used in place of the sodium formate and satisfactory viscosity control results.

When, instead of sodium formate, there is employed a like quantity of sodium adipate as the viscosity control agent and no other changes are made in the formulation or method of manufacture or use, a similarly successful liquid detergent is made, with the viscosity being 60 centipoises and other test results being essentially the same as for the sodium formate-containing detergent. When, however, the viscosity control agent is omitted, being replaced by a like quantity of water, the product is a solid at 24° C. and of course, does not flow at 7° C. When the Neodol 25-7 is replaced with Neodol 23-6.5 ($R'O(C_2H_4O)_{6.5}H$ wherein R' = mixed 12 and 13 carbon atoms primary alkyl) and the proportion of ethanol in the formulation is decreased to 8%, with the amount of water being increased accordingly, the product is fluid at 7° C. and has a viscosity of 72 centipoises at 24° C. It does not gel or form a skin upon a one hour exposure to air. Essentially the same results are obtained, with the detergent being thicker but still below 90 centipoises, when the proportion of alcohol present is reduced to 7%. Such product, despite lower ethanol content, does not form gel or skin on exposure to air in the test previously described. Washing tests of the described liquid detergent compositions containing viscosity control agents, conducted in the manner previously described, establish that they are also effective "heavy duty" laundry detergents when employed in the manner previously mentioned.

In a further variation of the formula, outside the present invention, when the sodium formate is replaced by a similar quantity of sodium acetate the viscosity of the product at 24° C. is higher, often greater than permissible to satisfy specifications for a liquid detergent of desirable flow properties. This is also the case when other monobasic organic alkanoic acids and alkali metal salts thereof are utilized in similar quantities and when dibasic acids or salts thereof outside the description previously given in the specification are employed. However, when $C_3$–$C_5$, $C_7$ and $C_9$ dibasic, completely neutralized, or partly neutralized sodium and other alkali metal or water soluble salts are utilized, preferably in mixture with disodium or other soluble adipate and/or sodium or other soluble formate, acceptable viscosities, washing characteristics and anti-gelling properties result, especially with the $C_5$ and $C_7$ compounds.

In still another formula, outside the present invention, made without a viscosity control agent of the type described but utilizing additional ethanol to exert further thinning effects, it is found that by employing as much as 13.7% of ethanol and diminishing the proportion of water accordingly, a satisfactory liquid detergent is obtainable which has a viscosity of 75 centipoises at 24° C., is pourable after storage for 2 weeks at 7° C. and does not form an objectionable skin on standing for a short time in air. However, such a product, on standing in the open, tends to lose alcohol more easily than the formulas of this invention and therefore can increase objectionably in viscosity faster during use.

EXAMPLE 2

| | % |
|---|---|
| Neodol 23-6.5 | 34.0 |
| Sodium dodecyl benzene sulfonate | 8.5 |
| Ethanol | 6.0 |
| Sodium formate | 4.0 |
| Perfume | 0.3 |
| Water | 47.2 |
| | 100.0 |

A clear liquid detergent of the above formula is prepared by dissolving the anionic detergent in the water, admixing the nonionic detergent with the solution, dissolving the perfume in the alcohol and admixing the alcoholic solution with the detergent solution, all operations being conducted at room temperature (25° C.). The liquid detergent resulting is tested in the manner described in Example 1 and is found to have a density of about 1.01 g./ml., a pH of about 7 and a viscosity of 63 centipoises. No skin or gel forms on the surface of the detergent after standing for 1 hour at room temperature in a beaker open to the atmosphere. When the liquid detergent temperature is lowered to 7° C. and maintained there for 2 weeks the product is still fluid and satisfactorily pourable.

When the same type of liquid detergent is made, of the same formula but with 1.3% of triethanolamine, 1% of color solution and 0.8% of optical brightener mixture present, replacing equal proportions of water, as in Example 1, and is made by the method of that example, similar results are obtained, with the viscosity being in the 60 to 70 centipoise range at 24° C. However, when the sodium formate is omitted from the formulation, being replaced by water, the product is not pourable, even at room temperature and therefore is unsatisfactory. When from 4 to 12% of lower alkanol is present, e.g., 5, 7 and 11%, with 1 to 5% of sodium formate, e.g., 5.5, 4 and 3% thereof, respectively, clear liquid detergents of satisfactory viscosities in the 40 to 120 centipoise range, usually in the 40 to 95 centipoise range, are producible. This is also the situation when the sodium formate in such experimental products is replaced with sodium adipate, sodium pimelate and sodium glutarate, with the adipate being preferred. Also, when instead of the disodium salts, other di-alkali metal salts, such as those of potassium and ammonium, half-neutralized forms such as the monosodium and monopotassium salts, and the acids are utilized, comparable good viscosity control is obtained and useful detergents which pass the tests mentioned are made.

In a variation of this experiment half of the sodium dodecyl benzene sulfonate is replaced with Neodol 25-3S and an acceptable pourable liquid detergent results. Such is also the case when sodium or potassium alpha-olefin sulfonate or sodium or potassium paraffin sulfonate of 14 to 18 carbon atoms and 13 to 17 carbon atoms, respectively, is used in replacement of half the alkali benzene sulfonate or are employed in approximately equal proportions with the Neodol 25-3S. This is also the case when the Neodol 25-3S is replaced with a similar compound having 14 to 17 carbon atoms in the higher alkanol and 4 to 5 ethoxy groups per mol or with one having 12 to 13 carbon atoms in the alkanol and two ethoxy groups per mol.

In the various formulas of this example described above the proportions of components can be varied from 20 to 40% with respect to the described nonionic detergent or a mixture thereof (Neodol 25-7 and Neodol 23-6.5, in equal parts, are useful, as also are mixtures of the previously named nonionic detergents with these nonionics), 3 to 15% of anionic detergent, 6 to 10% of ethanol and 1.5 to 5% of viscosity control agent, together with allowed proportions of the adjuvants. In such compositions mixtures of the various individual components may also be employed. In all such formulations the components and proportions thereof will be adjusted so as to provide the desired viscosity at room temperature and pourability at low temperatures.

When sodium propionate or sodium oxalate is substituted for the viscosity control agent in the experiments of this example unacceptable product is obtained, usually being too viscous and requiring additional amounts of lower alkanol to thin it sufficiently and adjust its viscosity to a desirable range.

EXAMPLE 3

In the formula of Example 2, containing 34% of Neodol 23-6.5, 8.5% of sodium dodecyl benzene sulfonate, 6% of ethanol, 4% of sodium formate, 1.3% of triethanolamine, 0.8% of optical brightener mixture, 1% of color solution, 0.3% of perfume and 44.1% of water, preferably deionized water, Tergitol 15-S-9, a higher alcohol polyethoxylate containing 11 to 15 carbon atoms in the alkyl group and about 9 ethoxies per mol, replaces the Neodol 23-6.5 and variations are made in the ethanol and sodium formate contents to obtain a satisfactory product. It is found that a product of desired viscosity can be obtained with a sodium formate content of 3% when the anhydrous ethanol percentage is 4.5, 5, 6 or 7. Similarly, satisfactory products with 2% sodium formate are those containing 5.5, 6, 7 and 8% of ethanol whereas with 1.5% of sodium formate good products are obtainable with from 6 to 10% of the alcohol.

In a similar experiment, when in the formula of Example 1 the proportion of sodium formate is varied from 1.5 to 4% with 10% ethanol present or is maintained in the 2.5 to 6% range with 8% ethanol present or is from 4 to 6% with 6% ethanol present a product of the desired viscosity is obtained, which does not gel after storage at 7° C. Variations in the proportions of sodium adipate and alcohol from 1 to 3% adipate with 10% ethanol, from 1.5 to 4% adipate with 9% ethanol and from 2 to 5% adipate with 8% ethanol are also satisfactory. When the formula of Example 2, with the triethanolamine, optical brightener mixture and coloring solution adjuvants present is varied, it is found that good products result using 1.5 to 4% of sodium formate and 8% ethanol, 2 to 5% sodium formate and 7% ethanol and 3 to 7% sodium formate and 6% ethanol.

EXAMPLE 4

| | % |
|---|---|
| Neodol 25-7 | 34.0 |
| Sodium linear near dodecyl benzene sulfonate | 8.5 |
| Triethanolamine | 1.3 |
| Ethanol | 5.5 |
| Isopropanol | 1.9 |
| Sodium formate | 2.0 |
| Optical brightener mixture (as in Example 1) | 0.8 |
| Perfume | 0.4 |
| Color solution (98.5% water) | 1.0 |
| Deionized water | 44.6 |
| | 100.0 |

The above liquid detergent is made according to the method described in Example 1 and the viscosity at room temperature and storage properties at low temperature are noted. The viscosity at 24° C. is 95 centipoises, using the Brookfield viscosimeter, as previously described, and the product is nongelling after 2 weeks storage at 7° C. It is an excellent liquid detergent, of properties like those of the products of the previous examples. When the anionic detergent employed is that of U.S. Pat. No. 3,320,174 and when it is terminally sulfonated the liquid detergent manufactured is of properties essentially the same as or equivalent to those described in Examples 1–3. The pH, about 9, may be raised or lowered within the range of 7 to 10 by the use of more triethanolamine or by acidification, respectively, without adversely affecting the desired viscosity and low temperature storage properties. Increasing the proportion of triethanolamine within the given range also allows the use of additional quantities of the optical brighteners or of other optical brighteners which are desirably additionally solubilized by the triethanolamine.

The Neodol 25-7 in the above formula may be replaced with Tergitol 15-S-7 or 15-S-9 without adverse effects and with the product having the desired viscosity and low temperature storage stability, while still being a good detergent. Similarly, it may be partially replaced, usually with only a minor proportion (less than 50%) by Neodol 25-3 or Neodol 45-11, so long as the viscosity remains in the desired range and the product does not separate or gel when stored for 2 weeks at 7° C. Variations in the proportions of isopropanol and ethanol within the range of 10:1 to 1:3, preferably 5:1 to 2:1 of ethanol: isopropanol may be used, with the product resulting still being a good detergent and of the desired viscosity and low temperature properties. Similar changes may be made in the formulas of Examples 1–3, as well as Example 4, with the ethanol content being replaced by a 3:1 mixture of ethanol and isopropanol and the products produced have properties like those of the comparable products wherein the organic alkanol solvent is solely ethanol.

Generally it is desirable, after settling on a formula of a particular type for best detergency and other associated properties, to vary the proportions of lower alkanol and viscosity control agent or mixture of such agents, measuring viscosities at 24° C. and noting the condition of the product after 24 hours standing at 7° C. Then, plots are made and product formulations are adjusted accordingly to produce the desired room temperature viscosity and low temperature anti-gelling properties most economically or with the greatest savings of alkanol. Thus, the present invention lends itself to use, with the benefit of such charts, for desirably and controllably adjusting the viscosities and anti-gelling properties of liquid detergents of these types.

When various additives are tried for viscosity control, such as sodium sulfate, urea, potassium xylene sulfonate and sodium fumarate, poor control is obtained and no substantial reductions of ethanol are made possible. Thus, the present viscosity control agents are suprisingly superior to various other additives and allow greater savings of ethanol solvent in these liquid detergent formulations.

The invention has been described with respect to working examples and illustrations thereof but is not to be limited to these because it is evident that one of skill in the art with access to the present specification will be able to employ substitutes and equivalents without departing from the spirit or scope of the invention.

What is claimed is:

1. A liquid detergent having a viscosity in the range of 40 to 100 centipoises at 24° C. and which is fluid at 7° C. which consists essentially of, by weight, from 10 to 60% of a water-soluble $C_2$–$C_3$ alkoxylated $C_{10}$–$C_{18}$ alkanol nonionic detergent, 4 to 12% of a $C_2$–$C_3$ alkanol, 1 to 6% of water-soluble salts of dibasic acids of the formula $(CH_2)_n(COOH)_2$, wherein $n$ is 3 to 5 as a viscosity control and gel prevention agent, and 22 to 84.5% of water.

2. A liquid detergent according to claim 1 in which the nonionic detergent is a polyethoxylated alkanol, said lower alkanol is selected from the group consisting of ethanol, isopropanol and mixtures thereof, and which contains from 20 to 40% of the polyethoxylated alkanol and 4 to 12% of a water-soluble synthetic organic anionic detergent salt having a carboxylate, sulfate or sulfonate group in its molecular structure and selected from the group consisting of sodium, potassium, ammonium and triethanolamine salts, 6 to 10% lower alkanol or mixture thereof, 1.5 to 5% of said dibasic acid salt and 29 to 69.5% of water.

3. A liquid detergent according to claim 2 wherein the nonionic detergent is a polyethoxylated $C_{10}$–$C_{18}$ alkanol having from 3 to 12 ethylene oxide groups per mol and the anionic detergent is selected from the group consisting of water-soluble salts of polyethoxylated $C_{10}$–$C_{18}$ alkanol ether sulfates having from 2 to 8 ethylene oxide groups per mol and $C_{10}$–$C_{15}$ alkyl benzene sulfonates.

4. A liquid detergent according to claim 1 wherein the nonionic detergent is a polyethoxylated higher alkanol wherein the higher alkanol is of 11 to 15 carbon atoms and which contains from 5 to 9 ethoxy groups per mol, the anionic detergent is a sodium salt, and said dibasic acid salt is a sodium salt.

5. A liquid detergent according to claim 4, which consists essentially of 30 to 40% of said polyethoxylated alkanol, 4 to 12% of the anionic detergent, which is a sodium polyethoxy linear higher alkanol sulfate wherein the alkanol is of 12 to 15 carbon atoms and which contains from 2 to 5 ethylene oxide groups per mol, 1.5 to 5% of sodium adipate, 6 to 8% of ethanol or a mixture of ethanol and isopropanol in which ethanol is present in a major proportion, and 34 to 57.5% of water.

6. A liquid detergent according to claim 4, which consists essentially of 30 to 40% of said polyethoxylated alkanol, 4 to 12% of the anionic detergent, which is a sodium higher alkyl benzene sulfonate wherein the higher alkyl is of 10 to 14 carbon atoms, 1.5 to 5% of sodium adipate, 6 to 8% of ethanol or a mixture of ethanol and isopropanol in which ethanol is present in a major proportion, and 34 to 57.5% of water.

7. A method of washing laundry which consists essentially of washing laundry with a liquid detergent having a viscosity of 40 to 100 centipoises at 24° C. and which is fluid at 7° C., which detergent consists essentially of, by weight, 10 to 60% of a water-soluble $C_2$–$C_3$ alkoxylated $C_{10}$–$C_{18}$ alkanol nonionic detergent, 4 to 12% of a $C_2$–$C_3$ alkanol, 1 to 6% of water-soluble salts of dibasic acids of the formula $(CH_2)_n(COOH)_2$, wherein $n$ is 3 to 5 as a viscosity control and gel prevention agent, and 22 to 84.5% of water.

8. A method according to claim 7 wherein the composition employed is that of claim 5.

9. A method according to claim 7 wherein the composition employed is that of claim 6.

* * * * *